US011403998B2

(12) United States Patent
Zheng et al.

(10) Patent No.: US 11,403,998 B2
(45) **Date of Patent: *Aug. 2, 2022**

(54) DISPLAY DEVICE WITH SELECTABLE LED CURRENT LEVELS BASED ON BRIGHTNESS DATA

(71) Applicant: Huayuan Semiconductor (Shenzhen) Limited Company, Shenzhen (CN)

(72) Inventors: Junjie Zheng, Cupertino, CA (US); Richard Landry Gray, Taipei (TW); Chih-Chang Wei, Taoyuan (TW)

(73) Assignee: Huayuan Semiconductor (Shenzhen) Limited Company, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/369,844

(22) Filed: Jul. 7, 2021

(65) Prior Publication Data

US 2022/0180799 A1 Jun. 9, 2022

Related U.S. Application Data

(63) Continuation of application No. 17/117,101, filed on Dec. 9, 2020, now Pat. No. 11,087,672.

(51) Int. Cl.
*G09G 3/32* (2016.01)
*G09G 5/10* (2006.01)

(52) U.S. Cl.
CPC ..... *G09G 3/32* (2013.01); *G09G 5/10* (2013.01); *G09G 2320/064* (2013.01); *G09G 2320/0633* (2013.01)

(58) Field of Classification Search
CPC ..... G09G 3/32; G09G 2320/064; G09G 5/10; G09G 2320/0633
See application file for complete search history.

(56) References Cited

U.S. PATENT DOCUMENTS 6,762,742 B2 7/2004 Moon et al.
7,276,863 B2 10/2007 Lee et al.
(Continued)

FOREIGN PATENT DOCUMENTS

JP 2002-202767 A 7/2002
JP 2002-258820 A 9/2002
(Continued)

OTHER PUBLICATIONS

United Stated Office Action, U.S. Appl. No. 17/117,101, filed Feb. 1, 2021, 11 pages.

*Primary Examiner* — Muhammad N Edun
(74) *Attorney, Agent, or Firm* — Fenwick & West LLP

(57) ABSTRACT

A display device comprises a control circuit and a plurality of LED channels coupled to a shared supply voltage. The control circuit obtains respective brightness levels for each of the LED channels and determines, based on the brightness levels, a group current level sufficient to drive all of the LED channels. The control circuit also determines respective duty cycles for each of the LED channels that will achieve the respective brightness levels when each of the LED channels are driven with the group current level. The control circuit configures driver circuits to drive the LED channels in accordance with the group current level and the respective duty cycles. The control circuit may furthermore obtain sensed channel voltages associated with each of the LED channels, and configure the shared voltage supply based on the sensed channel voltages to a voltage level sufficient to drive all of the LED channels.

20 Claims, 4 Drawing Sheets

(56) References Cited

U.S. PATENT DOCUMENTS

| | | | |
|---|---|---|---|
| 2002/0122020 | A1 | 9/2002 | Moon et al. |
| 2006/0175986 | A1 | 8/2006 | Lee et al. |
| 2011/0062872 | A1 | 3/2011 | Jin et al. |
| 2012/0223648 | A1 | 9/2012 | Jin et al. |
| 2013/0169172 | A1 | 7/2013 | Kesterson et al. |
| 2014/0247295 | A1 | 9/2014 | Hussain et al. |
| 2014/0307011 | A1 | 10/2014 | Ninan et al. |
| 2015/0076999 | A1 | 3/2015 | Malinin et al. |

FOREIGN PATENT DOCUMENTS

| | | | |
|---|---|---|---|
| JP | 2016-001341 | A | 1/2016 |
| KR | 10-2002-0032018 | A | 5/2002 |
| KR | 10-2006-0089375 | A | 8/2006 |

DISPLAY DEVICE WITH SELECTABLE LED CURRENT LEVELS BASED ON BRIGHTNESS DATA

CROSS-REFERENCE TO RELATED APPLICATION

This application is a continuation of U.S. patent application Ser. No. 17/117,101 filed on Dec. 9, 2020 which is incorporated by reference in its entirety.

BACKGROUND

This disclosure relates generally to a display device, and more specifically to a display device with selectable driving currents for light emitting diode (LED) channels.

LEDs are used in many electronic display devices, such as televisions, computer monitors, laptop computers, tablets, smartphones, projection systems, and head-mounted devices. With improvements in LED technology that reduce the physical size of the LEDs, display devices with significantly larger numbers of LEDs have become possible. However, as the density of LEDs in a display device increases, it becomes increasingly challenging to manage heat dissipation and power consumption.

SUMMARY

A display device includes a control circuit and a plurality of LED channels coupled to a shared supply voltage. For a given image frame, the control circuit obtains brightness data comprising respective brightness levels for each of the LED channels. The control circuit determines, based on the brightness levels, a group current level sufficient to drive all of the LED channels. For example, the control circuit selects the group current level from a set of predefined current levels. The control circuit also determines for each of the LED channels based on the respective brightness levels and the group current level, respective duty cycles for each of the LED channels to achieve the respective brightness levels when each of the LED channels are driven with the group current level. The control circuit configures driver circuits to drive the LED channels in accordance with the group current level and the respective duty cycles. The group current level and respective duty cycles may be updated each frame based on the brightness levels.

In an embodiment, the control circuit maps the respective brightness levels for each of the LED channels to respective average channel currents for each of the LED channels. The control circuit then selects the group current level as a lowest one of the set of predefined current levels that exceeds all of the respective average channel currents. The control circuit furthermore configures the respective duty cycles by determining the respective ratios of the respective average channel currents for each of the LED channels to the group current level.

In an embodiment, the control circuit furthermore sets the shared supply voltage to a voltage level sufficient to drive all of the LED channels when operating with the group current level. Here, the control circuit may determine a preset supply voltage level for the shared supply voltage selected from a set of predefined supply voltage levels each corresponding to one of the predefined current levels. The control circuit may furthermore obtain respective channel voltages associated with the each of the LED channels, determine a minimum channel voltage of the respective channel voltages associated with each of the LED channels, and adjust the shared voltage supply based on the minimum channel voltage across the LED channels.

In a further embodiment, the control circuit determines that the group current level for a current frame is unchanged from an immediately prior frame and sets the shared supply voltage to a same voltage level as the immediately prior frame.

In an embodiment of the display device, the LEDs may comprise mini-LEDs having a size range between 100 to 300 micrometers, or micro-LEDs having a size of less than 100 micrometers.

BRIEF DESCRIPTION OF THE DRAWINGS

The teachings of the embodiments of the present invention can be readily understood by considering the following detailed description in conjunction with the accompanying drawings.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive aspect matter.

DETAILED DESCRIPTION OF EMBODIMENTS

Figure 1:
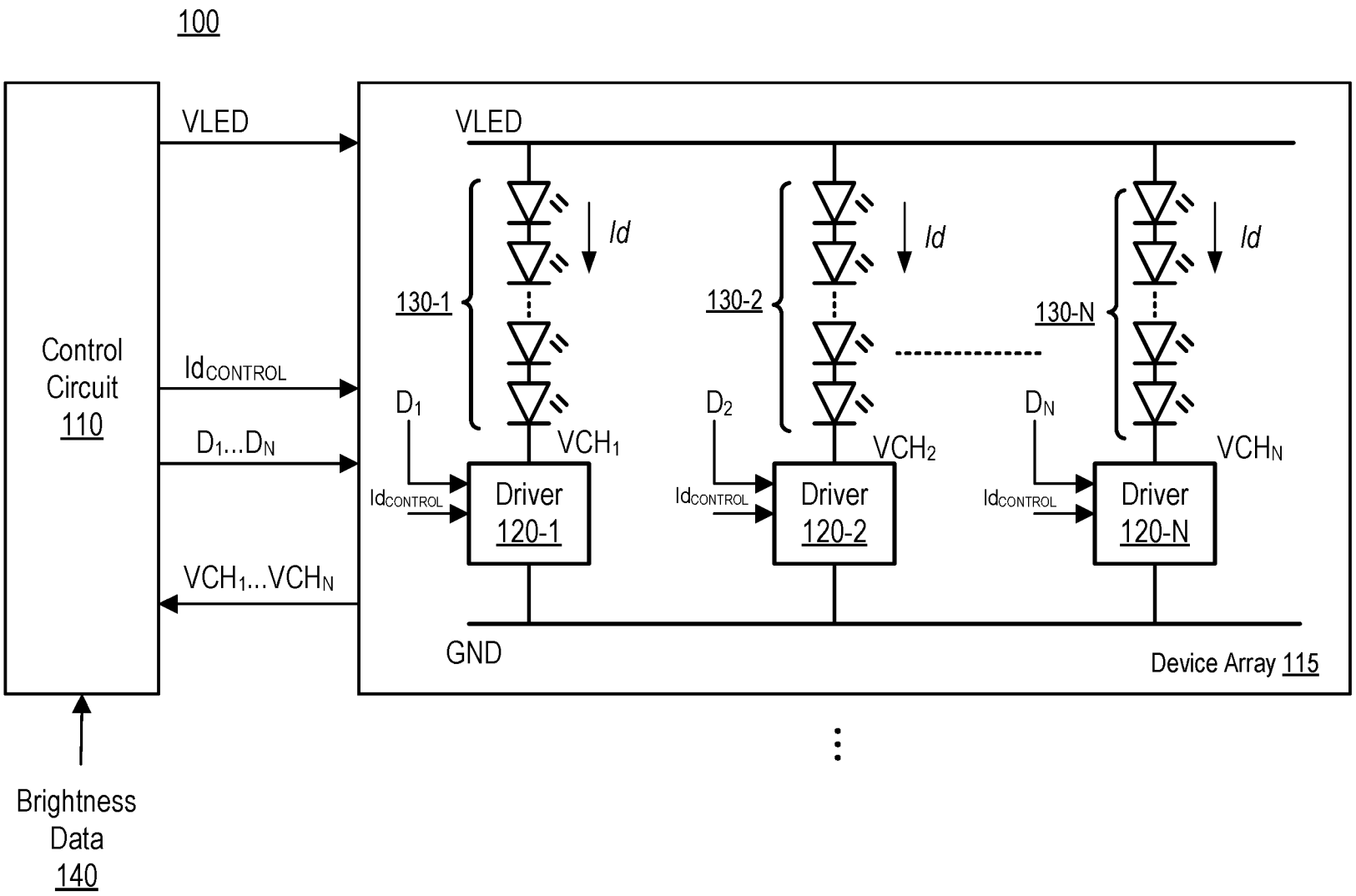
FIG. 1 is a circuit diagram illustrating an example of a display device.

FIG. 1 is a circuit diagram of a display device 100 for displaying images or video. In various embodiments, the display device 100 may be implemented in any suitable form-factor, including a display screen for a computer display panel, a television, a mobile device, a billboard, etc. The display device 100 includes a control circuit 110 and a device array 115 including a plurality of LED channels 130 driven by corresponding driver circuits 120 for driving the LED channels 130. Each of the LED channels 130 comprises a single LED or a set of series LEDs coupled in an LED string. Each driver circuit 120 is coupled to an LED channel 130 to control respective LED currents Id through the LED channels 130. Since LEDs are current-driven devices, the brightness of each LED channel 130 varies with the current Id. Each of the LED channels 130 may furthermore share a voltage supply line VLED that supplies a voltage to the LED channels 130.

While FIG. 1 illustrates a single device array 115, the LED device 100 may include multiple device arrays 115 coupled to a single control circuit 110 or a set of distributed control circuits 110. For example, the device array 115 may correspond to a row of a display device 100 and the display device may include multiple such rows. Each device array 115 (e.g., row) may include a set of LED channels 130 having a shared supply voltage VLED. Alternatively, the device array 115 may correspond to a column of a display device 100. In further embodiments, a device array 115 may correspond to a block of adjacent LED channels 130 that may space multiple row and columns. In further embodiments, the device array 115 may correspond to any arbitrary group of LED channels 130 and corresponding driver circuits 120 coupled by a common supply line VLED, but which are not necessarily physically adjacent.

The display device 100 may comprise a liquid crystal display (LCD) device or an LED display device. In an LCD display device, the LEDs provide white light backlighting that passes through liquid crystal color filters that control the color of individual pixels of the display. In an LED display device, LEDs are directly controlled to emit colored light corresponding to each pixel of the display device 100. The LEDs of each LED zone 130 may be organic light emitting diodes (OLEDs), inorganic light emitting diodes (ILEDs), mini light emitting diodes (mini-LEDs) (e.g., having a size range between 100 to 300 micrometers), micro light emitting diodes (micro-LEDs) (e.g., having a size of less than 100 micrometers), white light emitting diodes (WLEDs), active-matrix OLEDs (AMOLEDs), transparent OLEDs (TOLEDs), or some other type of LEDs.

In an embodiment, the driver circuits 120 are distributed in a display area of the display device 100. Here, each driver circuit 120 and its corresponding LED channel 130 may be embodied in an integrated package such that the LEDs of the LED channel 130 are stacked over the driver circuit 120 on a substrate. Alternatively, the driver circuits 120 and LEDs of the LED channels 130 may be embodied in separate packages. In further embodiments, the driver circuits 120 are not necessarily distributed in the display area and may instead be physically located around an edge of the display area. The driver circuits 120 in a device array 115 may be separate devices as illustrated in FIG. 1, or some or all of the driver circuits 120 may be integrated together in a shared driver circuit package. For example, in one embodiment, each driver circuit 120 drives three color channels (e.g., red, green, and blue) corresponding to a pixel. In other embodiments, multiple pixels are driven by a set of driver circuits in a single package.

The driver circuits 120 control brightness of their respective LED channels 130 based on a current control signal $Id_{CONTROL}$ and respective duty cycle signals $D_1 \ldots D_N$. In an embodiment, for each image frame, the set of driver circuits 120 in an array all receive the same current control signal $Id_{CONTROL}$ but receive different duty cycle signals $D_1 \ldots D_N$. The duty cycle signals $D_1 \ldots D_N$ control the percentage of time during each frame period when the LED are on. During the on-times, the LED channels 130 each conduct channel currents Id set by the current control signal $Id_{CONTROL}$. During the off-times, the channel currents Id are zero or near zero. The current control signal $Id_{CONTROL}$ and duty cycle signals $D_1 \ldots D_N$ may be updated for each image frame. The average brightness of an LED channel 130 is proportional to the product of its current Id and duty cycle. Thus, brightness may be adjusted from frame-to-frame by either changing the current Id, the duty cycle signals $D_1 \ldots D_N$, or both.

The control circuit 110 receives brightness data 140 for each image frame that specifies brightness levels for each LED channel 130 of the display device 100. Based on the brightness data 140, the control circuit 110 generates the current control signal $Id_{CONTROL}$ for the group of LED channels 130 and the respective duty cycles $D_1 \ldots D_N$ that achieve the specified brightness levels. The control circuit 110 also sets the LED supply voltage VLED based on the determined current Id (or directly based on the brightness data 140). In at least some frames (e.g., when the current Id changes), the control circuit 110 also obtains sensed channel voltages $VCH_1 \ldots VCH_N$ for each LED channel 130 (representing a voltage across the driver circuit 120), and may further adjust the LED supply voltage VLED based on the sensed channel voltages $VCH_1 \ldots VCH_N$. A process for setting the channel current Id the respective duty cycles $D_1 \ldots D_N$, and the voltage supply VLED is described in further detail below with respect to FIG. 2.

Figure 2:
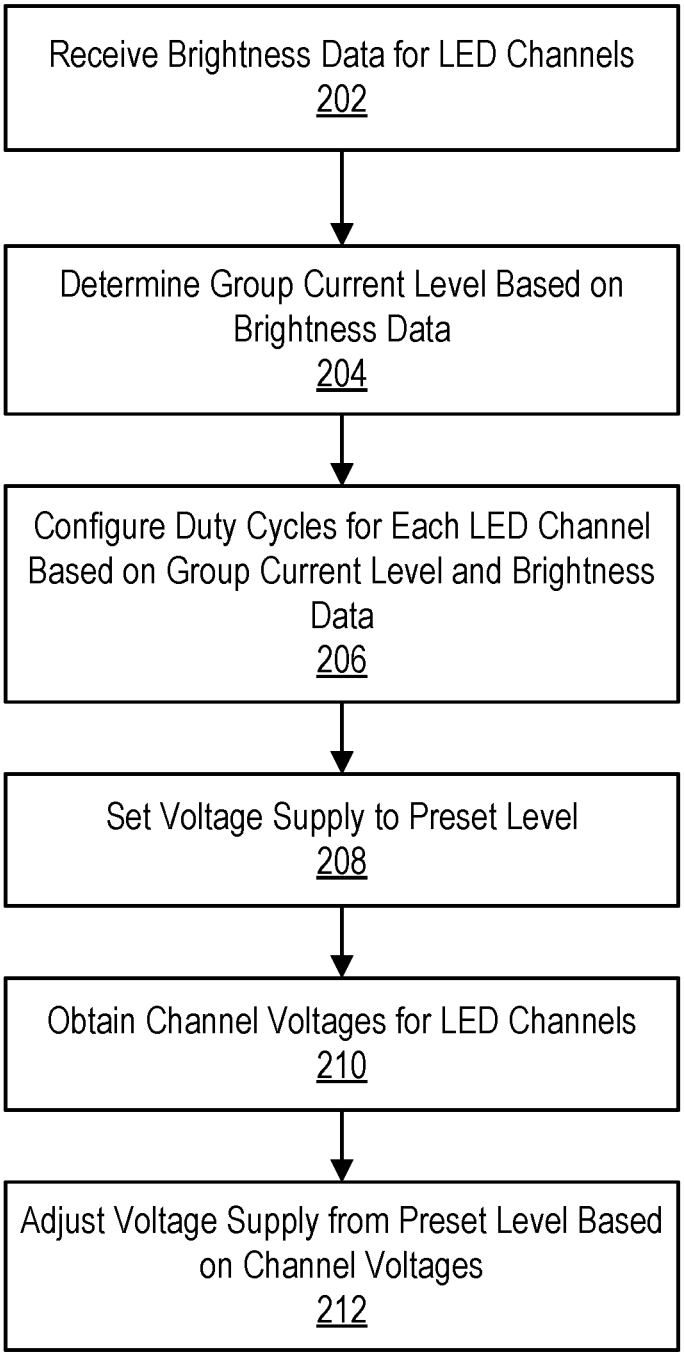
FIG. 2 is a flowchart illustrating an example embodiment of a first process for controlling LED channels of a display device.

FIG. 2 is an example embodiment of a process for configuring a display device 100. For a given image frame, the control circuit 110 receives 202 brightness data 140 specifying respective brightness levels for each LED channel 130. The control circuit 110 determines 204 a group current level Id for driving each of the LED channels 130 based on the brightness data. Here, the control circuit 110 maps the brightness levels for each LED channel 130 to respective desired channel currents $ICH_1 \ldots ICH_N$ at a 100% duty cycle. This mapping may be performed, for example, using a lookup table that maps different brightness levels to a different average channel currents ICH that achieve the brightness level. The mapping may be based on non-linear device characteristics of the LEDs. The control circuit 110 sets the group current level Id to a level at least as high as the maximum desired average channel current $ICH_{MAX}$ determined from the brightness data. Here, the maximum desired average channel current $ICH_{MAX}$ represents a current level that will achieve the desired brightness when operating the channel at 100% duty cycle. In an embodiment, the group current level Id may be selected from a set of predefined current levels, and the control circuit 110 selects the minimum current from the set of predefined current levels that is at least as high as the maximum desired average channel current $ICH_{MAX}$. For example, in one embodiment using three selectable current levels, the group current level Id is selected as follows:

$$Id = \begin{cases} I_A \text{ if } ICH_{Max} > I_B \\ I_B \text{ if } I_B \geq ICH_{Max} > I_C \\ I_C \text{ if } ICH_{Max} \leq I_C \end{cases} \quad (1)$$

where $I_A$, $I_B$, $I_C$ are predefined selectable current levels (e.g., $I_A$=20 mA, $I_B$, =10 mA, $I_C$=1 mA). The control circuit 110 sets all LED channels 130 in the device array 115 to operate using the same group current level Id.

The control circuit 110 then configures 206 duty cycles $D_1 \ldots D_N$ for the respective LED channels 130 based on the group current level Id and the brightness levels. Here, the control circuit 110 sets the duty cycles $D_1 \ldots D_N$ so that the average brightness for the frame period meets the brightness levels set by the brightness data when the respective LED channels 130 are all driven according to the group current level Id. For example, the duty cycles $D_1 \ldots D_N$ are set to a ratio between the desired average channel current ICH that will achieve the brightness level and the group current level. In an embodiment, the duty cycles $D_1 \ldots D_N$ can be determined as:

$$D_i = \frac{ICH_i}{Id} \quad (2)$$

Figure 3:
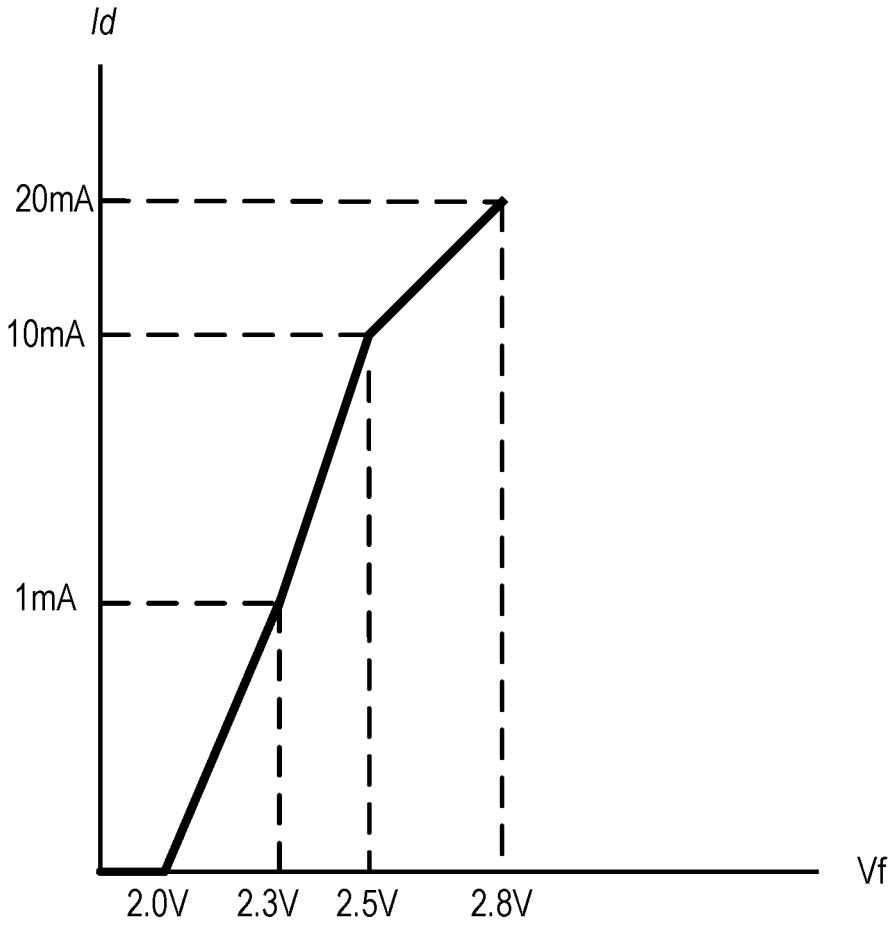
FIG. 3 is a graph illustrating a piecewise linear approximation of a relationship between a forward voltage and channel current of an LED.

The control circuit 110 also sets the LED voltage supply VLED to a preset voltage level $VLED_{PRE}$ based on the selected group current level Id (or directly based on the brightness data). In an embodiment, the preset voltage level $VLED_{PRE}$ may be selected from a set of predefined voltage levels each corresponding to one of the predefined current levels. The relationship between the preset supply voltage $VLED_{PRE}$ and the group current level Id may be predetermined based on the number of LEDs in each channel, the forward voltage Vf(Id) across each LED when operating at the group current level Id, and a predefined target channel voltage $VCH_{TARGET}$ representing an operating voltage across the driver circuit 120. For example, the relationship may be as follows:

$$VLED_{PRE}(Id)=Vf(Id)*N+VCH_{TARGET} \quad (3)$$

where Vf(Id) may be approximated based on observed device characteristics as described in FIG. 3 discussed below. In operation, the selected voltage for $VLED_{PRE}$ may be directly selected based on the brightness data or the corresponding average channel current ICH using a pre-populated lookup table.

The control circuit 110 may furthermore obtain 210 channel voltages $VCH_1 \ldots VCH_N$ for each of the LED channels 130 during the on-times of at least some of the frames. The channel voltages $VCH_1 \ldots VCH_N$ may be obtained, for example, based on sensors integrated in the driver circuit 120 or from separate voltage sensors. The control circuit 110 adjusts 212 the preset supply voltage $VLED_{PRE}$ based on the sensed channel voltages $VCH_1 \ldots VCH_N$. Here, the control circuit 110 may detect the lowest channel voltage $VCH_{MIN}$ and adjust the LED supply voltage VLED as a function of the lowest channel voltage $VCH_{MIN}$. For example, in one embodiment, the control circuit 110 may adjust VLED from the preset supply voltage $VLED_{PRE}$ as follows:

$$VLED=VLED_{PRE}-VCH_{MIN}+VCH_{TARGET} \quad (4)$$

Adjusting the supply voltage VLED in this way enables the control circuit 110 to maintain the supply voltage VLED at or near a minimum operating voltage level sufficient to drive the LED channels 130 while minimizing power consumption of the display device 100.

In an embodiment, the control circuit 110 configures the supply voltage VLED according to steps 208, 210, 212 only during frames in which the group current level Id changes from the previous frame, i.e., when $Id_i \neq Id_{i-1}$ where i is the frame number. Otherwise, the control circuit 110 maintains the same supply voltage VLED as the previous frame and need not necessarily adjust the preset supply voltage $VLED_{PRE}$ or perform any channel sensing. Alternatively, the control circuit 110 senses the channel voltages VCH every frame or every fixed number of frames even when the group current level Id stays the same.

In display devices 100 with multiple device arrays 115 (e.g., each corresponding to a row of the display device 100), the process of FIG. 2 may be performed sequentially or in parallel to set a group current level for each device array 115 and respective duty cycles for each of the LED channels 130 in the device array 115. For example, if each device array 115 corresponds to a row, each row of the display device may separately configure their respective group currents Id and supply voltages VLED. The process may furthermore be performed for each image frame to update the group current level and duty cycles as the brightness levels change.

In an embodiment, the set of predefined current levels from which the group current level Id is selected and the corresponding preset supply voltages $VLED_{PRE}$ are derived from an approximation of the non-linear relationship between the current level Id and the forward voltage (Vf) representing the voltage drop across each LED in the LED channel 130. FIG. 3 is a graph illustrating a piecewise linear approximation of this relationship. In this example, the LEDs have a forward voltage Vf of approximately 2.3V for a channel current Id=1 mA, a forward voltage Vf of approximately 2.5V for a channel current Id=10 mA, and a forward voltage Vf of approximately 2.8V for a channel current Id=20 mA. The non-linearity of the Id-Vf curve results in lower power consumption at the same brightness level when the LED channel 130 is operated at a lower channel current (and higher duty cycle) than when the LED channel 130 is operated at a higher channel current (and lower duty cycle). As an example, an LED channel 130 may be controlled to achieve an average channel current ICH=8 mA. For a first LED channel operating at $Id_1$=20 mA, the appropriate duty cycle is computed as:

$$D_1 = \frac{ICH_1}{Id_1} = \frac{8\text{ mA}}{20\text{ mA}} = 0.4 \quad (5)$$

At $Id_1$=20 mA, the expected forward voltage drop is $Vf_1$=2.8V. The power consumption per LED is therefore computed as:

$$P_1=Vf_1 \cdot Id_1 \cdot D_1=2.8V \cdot 20mA \cdot 0.4=22.4mW \quad (6)$$

For a second LED channel, operating at $Id_2$=10 mA, the appropriate duty cycle is computed as:

$$D_2 = \frac{ICH_2}{Id_2} = \frac{8\text{ mA}}{10\text{ mA}} = 0.8 \quad (7)$$

At $Id_2$=10 mA, the expected forward voltage drop is $Vf_2$=2.5V. The power consumption per LED is therefore computed as:

$$P_2=Vf_2 \cdot Id_2 \cdot D_2=2.5V \cdot 10mA \cdot 0.8=20mW \quad (8)$$

As can be seen from the calculations of $P_1$ and $P_2$, it is favorable from a power consumption standpoint to operate the LED channel 130 at the lower current level $Id_2$=10 mA and higher duty cycle $D_2$=0.8 to achieve the desired brightness than to operate a higher current level $Id_2$=20 mA and lower duty cycle $D_1$=0.4. Thus, by varying both the current level and duty cycles of the LED channels 130 dependent on the brightness data, the display device 100 can achieve lower power consumption than devices operating with fixed current levels that only vary the duty cycles.

Figure 4:
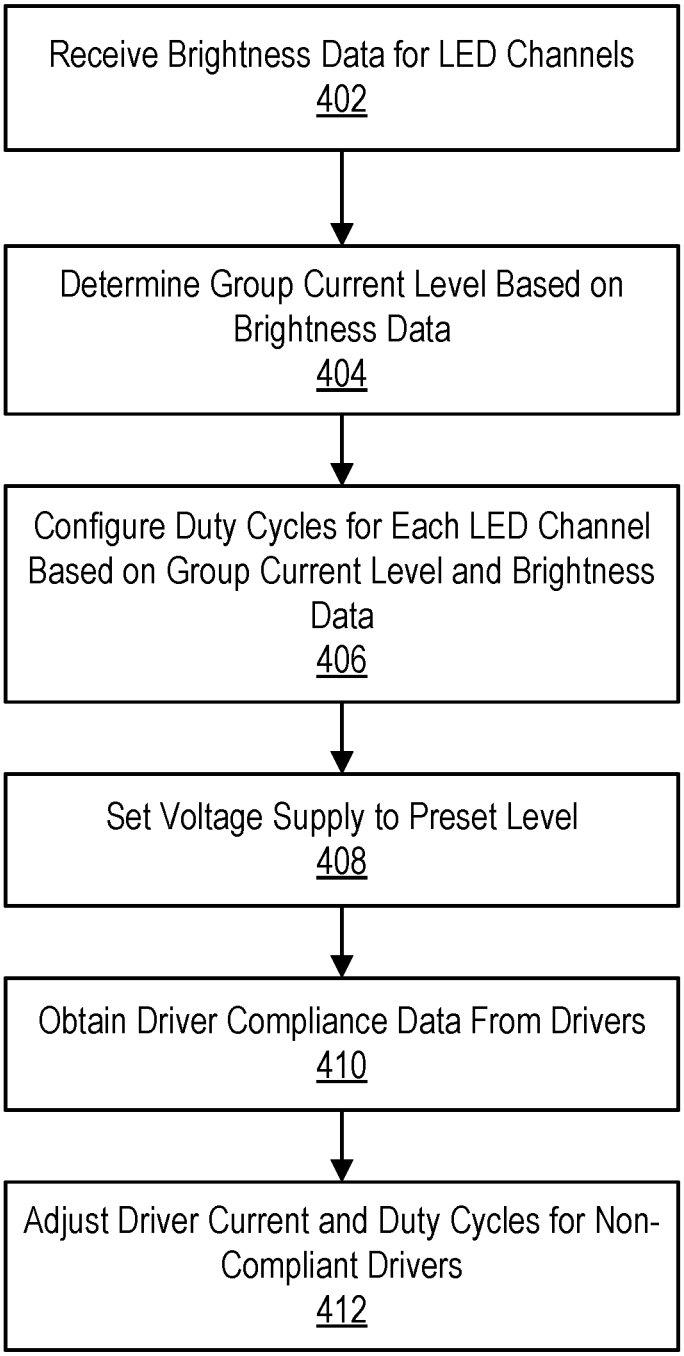
FIG. 4 is a flowchart illustrating an example embodiment of a second process for controlling LED channels of a display device.

In another embodiment, the control circuit 110 can send current control signals $Id_{CONTROL}$ that cause one or more LED channels 130 within a group to operate with current levels $Id_i$ that are not necessarily identical for every LED channel 130 in a given frame. FIG. 4 illustrates an example embodiment of a control process using varying channel current levels. Similarly to FIG. 2 described above, the control circuit 110 receives 402 brightness data for each LED channel, determines 404 a group current level based on the brightness data, configures 406 initial duty cycles for each LED channel based on the group current level and brightness data, and initially sets 408 the voltage supply VLED to a preset level $VLED_{PRE}$. In the embodiment of FIG. 4, the preset level $VLED_{PRE}$ is not necessarily based on the relationship in Eq. 3 and FIG. 3, but may represent some predefined level associated with the group current level Id. The control circuit 110 then obtains 410 driver compliance signals from one or more driver circuits 120 that identifies driver circuits 120 that are unable to source the group current level Id at the preset supply voltage $VLED_{PRE}$. The control circuit 110 may send an updated current control signal $Id_{CONTROL}$ to the non-compliant drivers to adjust 412 the channel currents Idi and duty cycles for the non-complaint drivers. Specifically, the control circuit 110 decreases the channel currents $Id_i$ for the non-compliant drivers 120 to respective levels (e.g., maximum levels) at which each driver circuit 120 can source the channel current Idi at the current supply voltage VLED. The adjustment in the current level Idi may be different for each non-compliant driver circuit 120. The control circuit 110 furthermore increases the duty cycle from the initial values to achieve the programmed brightness at the adjusted current level Idi for each of the non-compliant driver circuits 120. If the desired brightness cannot be achieved at the current VLED even at 100% duty cycle for at least one non-compliant driver circuit 120, then the control circuit 110 may increase VLED to level at which all driver circuits 120 can be in compliance (e.g., at some margin above the minimum level that enables compliance).

Upon reading this disclosure, those of skill in the art will appreciate still additional alternative embodiments through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the scope described herein.

The invention claimed is:

1. A method for controlling a display device comprising a group of LED channels having a shared supply voltage, the method comprising:

receiving brightness data comprising respective brightness levels for each of the LED channels in the group;

determining, based on the brightness levels, a group current level sufficient to drive all of the LED channels;

determining a voltage level for the shared supply voltage to drive all of the LED channels when operating with the group current level;

configuring driver circuits to drive the LED channels in accordance with the group current level using the voltage level for the shared supply voltage;

detecting a non-compliant driver circuit from the driver circuits, the non-compliant driver circuit failing to drive a respective LED channel at the group current level using the voltage level for the shared supply voltage;

determining an adjusted current level for the non-compliant driver circuit that the non-compliant driver circuit can drive from the voltage level for the shared supply voltage, the adjusted current level different from the group current level; and configuring the non-compliant driver circuit to drive the respective LED channel in accordance with the adjusted current level using the voltage level for the shared supply voltage.

2. The method of claim 1, wherein determining the group current level comprises:

selecting the group current level from a set of predefined current levels.

3. The method of claim 2, wherein selecting the group current level from the set of predefined current levels comprises:

mapping the respective brightness levels for each of the LED channels to respective average channel currents for each of the LED channels; and selecting the group current level as a lowest one of the set of predefined current levels that exceeds all of the respective average channel currents.

4. The method of claim 1, further comprising:

determining, for each of the LED channels in the group based on the respective brightness levels and the group current level, respective duty cycles for each of the LED channels to achieve the respective brightness levels when each of the LED channels are driven with the group current level, wherein the driver circuits are configured to drive the LED channels in accordance with the group current level using the voltage level for the shared supply voltage and the respective duty cycles for each of the LED channels.

5. The method of claim 4, wherein configuring the respective duty cycles comprises:

mapping the respective brightness levels for each of the LED channels to respective average channel currents for each of the LED channels; and determining respective ratios of the respective average channel currents for each of the LED channels to the group current level.

6. The method of claim 1, further comprising:

setting the shared supply voltage to a voltage level sufficient to drive all of the LED channels when operating with the group current level.

7. The method of claim 6, where setting the shared supply voltage comprises:

determining a preset supply voltage level for the shared supply voltage selected from a set of predefined supply voltage levels each corresponding to one of the predefined current levels.

8. The method of claim 6, wherein setting the shared supply voltage further comprises:

obtaining respective channel voltages associated with the each of the LED channels;

determining a minimum channel voltage of the respective channel voltages associated with each of the LED channels; and adjusting the shared voltage supply based on the minimum channel voltage across the LED channels.

9. The method of claim 6, wherein setting the shared supply voltage comprises:

determining that the group current level for a current frame is unchanged from an immediately prior frame; and setting the shared supply voltage to a same voltage level as the immediately prior frame.

10. The method of claim 1, wherein configuring the non-compliant driver comprises:

adjusting a duty cycle for the non-compliant driver circuit to achieve a brightness level for the non-compliant driver circuit at the adjusted current level.

11. The method of claim 1, further comprising:

determining that a programmed brightness level for the non-compliant driver circuit is unachievable at the adjusted current level; and adjusting the voltage level to an adjusted voltage level that enables the non-compliant driver circuit to achieve the programmed brightness level.

12. A display device comprising:

a group of LED channels each comprising a string of LEDs;

a shared supply voltage supplying power to each of the LED channels;

a set of driver circuits configured to drive the LED channels according to a group current level and respective duty cycles for each of the LED channels;

a control circuit configured to:

receive brightness data comprising respective brightness levels for each of the LED channels in the group;

determine, based on the brightness levels, the group current level sufficient to drive all of the LED channels;

determine a voltage level for the shared supply voltage to drive all of the LED channels when operating with the group current level;

configure the set of driver circuits to drive the LED channels in accordance with the group current level using the voltage level for the shared supply voltage;

detect a non-compliant driver circuit from the set of driver circuits, the non-compliant driver circuit failing to drive a respective LED channel at the group current level using the voltage level for the shared supply voltage;

determine an adjusted current level for the non-compliant driver circuit that the non-compliant driver circuit can drive from the voltage level for the shared supply voltage, the adjusted current level different from the group current level; and configure the non-compliant driver circuit to drive the respective LED channel in accordance with the adjusted current level using the voltage level for the shared supply voltage.

13. The display device of claim 12, wherein the control circuit is configured to determine the group current level by selecting the group current level from a set of predefined current levels.

14. The display device of claim 13, wherein the control circuit is configured to select the group current level from the set of predefined current levels by mapping the respective brightness levels for each of the LED channels to respective average channel currents for each of the LED channels, and selecting the group current level as a lowest one of the set of predefined current levels that exceeds all of the respective average channel currents.

15. The display device of claim 12, wherein the control circuit is further configured to determine, for each of the LED channels in the group based on the respective brightness levels and the group current level, respective duty cycles for each of the LED channels to achieve the respective brightness levels when each of the LED channels are driven with the group current level, wherein the driver circuits are configured to drive the LED channels in accordance with the group current level using the voltage level for the shared supply voltage and the respective duty cycles for each of the LED channels.

16. The display device of claim 15, wherein configuring the respective duty cycles comprises:

mapping the respective brightness levels for each of the LED channels to respective average channel currents for each of the LED channels; and determining respective ratios of the respective average channel currents for each of the LED channels to the group current level.

17. The display device of claim 12, wherein the control circuit is configured to set the shared supply voltage to a voltage level sufficient to drive all of the LED channels when operating with the group current level.

18. The display device of claim 17, wherein the control circuit is configured to set the shared supply voltage by determining a preset supply voltage level for the shared supply voltage selected from a set of predefined supply voltage levels each corresponding to one of the predefined current levels.

19. The display device of claim 12, wherein the control circuit configures the non-compliant driver by adjusting a duty cycle for the non-compliant driver circuit to achieve a brightness level for the non-compliant driver circuit at the adjusted current level.

20. The display device of claim 12, wherein the control circuit is further configured to:

determine that a programmed brightness level for the non-compliant driver circuit is unachievable at the adjusted current level; and adjust the voltage level to an adjusted voltage level that enables the non-compliant driver circuit to achieve the programmed brightness level.

* * * * *